US005642858A

United States Patent [19]

Kakehashi et al.

[11] Patent Number: 5,642,858

[45] Date of Patent: Jul. 1, 1997

[54] THERMAL EXPANSION VALVE

[75] Inventors: Nobuharu Kakehashi, Toyoake; Yoshitaka Tomatsu, Chiryu; Hiroshi Kishita, Anjo; Yasushi Yamanaka, Nakashima-gun; Kenichi Fujiwara, Kariya, all of Japan

[73] Assignee: Nippondenso Co., Ltd., Kariya, Japan

[21] Appl. No.: 619,213

[22] Filed: Mar. 21, 1996

[30] Foreign Application Priority Data

Mar. 22, 1995 [JP] Japan ..... 7-062256
Oct. 12, 1995 [JP] Japan ..... 7-264189

[51] Int. Cl.[6] ..... F25B 41/04

[52] U.S. Cl. ..... 236/92 B; 62/225

[58] Field of Search ..... 236/92 B, 99 R, 236/99 J; 62/225

[56] References Cited

U.S. PATENT DOCUMENTS

| | | | |
|---|---|---|---|
| 2,272,250 | 2/1942 | Persons | 236/92 B |
| 2,701,688 | 2/1955 | Dillman | 236/92 B |
| 4,344,566 | 8/1982 | Gotzenberger | 62/225 |
| 4,819,443 | 4/1989 | Watanabe et al. | 236/92 B |
| 5,127,237 | 7/1992 | Sendo et al. | 62/225 |

FOREIGN PATENT DOCUMENTS 6-26741 2/1994 Japan .

*Primary Examiner*—William E. Tapolcai
*Attorney, Agent, or Firm*—Cushman, Darby & cushman IP Group of Pillsbury Madison & Sutro LLP

[57] ABSTRACT

According to the present invention, a thermal expansion valve for a refrigerating cycle includes a housing having a throttle passage therein for expanding the refrigerant thereinto from the high-pressure side liquid refrigerant circuit, a valve element provided within the housing for adjusting opening degree of the throttle passage, and a thermosensitive element movably disposed within the housing. The thermosensitive element includes a case and a pressure responding member disposed within the case and displacing according to temperature and pressure of the refrigerant at the exit of an evaporator. The case of the thermosensitive element is integrally connected to the valve element, and the thermosensitive element and the valve element are so constructed as to integrally move according to the displacement of the pressure responding member. Accordingly, even if the valve element vibrates due to the sharp expansion of the refrigerant and the vibration transmits to the thermosensitive element case, as the thermosensitive element case is movable with respect to the housing and the housing are separated from the thermosensitive case, most of the vibration is prevented from being transmitted to the housing.

11 Claims, 17 Drawing Sheets

THERMAL EXPANSION VALVE

CROSS REFERENCE TO RELATED APPLICATIONS

This application is based on and claims priority of from Japanese Patent Application Nos. Hei 7-62256 filed on Mar. 22, 1995 and Hei 7-264189 filed on Oct. 12, 1995, the content of which are incorporated herein by reference.

BACKGROUND OF THE INVENTION

1. Field of the Invention:

The present invention generally relates to a thermal expansion valve. More particularly, the present invention relates to a thermal expansion valve, for use in a refrigerating cycle, which expands refrigerant flowing thereinto from a high-pressure side liquid refrigerant circuit by reducing the pressure of such refrigerant according to the overheat of refrigerant at the outlet of an evaporator, and is preferably applied to, for example, a thermal expansion valve used for an automotive air conditioning system.

2. Description of Related Art:

Conventionally, as this type of thermal expansion valve, a thermal expansion valve, in which a thermosensitive element part for sensing the temperature of the refrigerant at the exit of an evaporator is incorporated in a housing in addition to a built-in expansion mechanism part, has been known, as disclosed in the Japanese Unexamined Patent publication No. Hei 6-26741.

The thermosensitive element part is fixed to the housing. On the other hand, the valve element of the expansion mechanism is operated in response to the displacement of a diaphragm provided within the case of the thermosensitive element.

As a result of experiments and examination by the inventors of the present invention, it was found that noise had been caused by the following reason due to the operation of the expansion valve:

The valve element of the expansion mechanism adjusts an opening of a throttle passage which sharply reduces high-pressure liquid refrigerant flowing thereinto from a high-pressure side liquid refrigerant circuit and thereby expands the refrigerant. Therefore, the valve element repeats a minute vibration by an influenced of the sharp pressure reduction and expansion of the refrigerant within the throttle passage.

The vibration of the valve element transmits to the housing though a valve stem linked to the valve element, a metallic contacting member in contact with the valve stem, the metallic diaphragm in contact with the contacting member, and a case of the thermoelement, for fixedly holding the outer circumferential portion of the diaphragm.

Therefore, it turns out that the noise caused by the vibration of the valve element is released to the outside via the housing, a refrigerant piping connected to the housing, and other components.

SUMMARY OF THE INVENTION

In view of the above, it is an object of the present invention to reduce the noise caused by the vibration of the valve element of the thermal expansion valve.

According to the present invention, a thermal expansion valve for a refrigerating cycle includes a housing having a throttle passage therein for expanding the refrigerant thereinto from the high-pressure side liquid refrigerant circuit, a valve element provided within the housing for adjusting opening degree of the throttle passage, and a thermosensitive element movably disposed within the housing. The thermosensitive element includes a case and a pressure responding member disposed within the case and displacing according to temperature and pressure of the refrigerant at the exit of an evaporator. The case of the thermosensitive element is integrally connected to the valve element, and the thermosensitive element and the valve element are so constructed as to integrally move according to the displacement of the pressure responding member.

By the integral movement of the thermosensitive element and the valve element according to the displacement of the pressure responding member of the thermosensitive element, the opening degree of the throttle passage is adjusted, and thereby the overheat of the refrigerant at the exit of the evaporator can be adjusted.

Accordingly, even if the valve element vibrates due to the sharp expansion of the refrigerant within the throttle valve and the vibration transmits to the thermosensitive element case, as the thermosensitive element case is movable with respect to the housing and the housing are separated from the thermosensitive case, most of the vibration is prevented from being transmitted to the housing.

As a result, the transmission of the vibration to the outside through the housing members can effectively be prevented, and thereby an expansion valve of low noise type can be provided.

Further, an end of the spring member may be adjustably supported by the adjusting screws. Therefore, the setting load of the spring member can be easily adjusted by the adjusting screws, and the setting value of the refrigerant overheat due to the thermal expansion valve the can easily be adjusted.

Furthermore, the setting load of the spring member may be adjusted by press deforming the wall surface of the housing. Therefore, the setting value of the refrigerant overheat level can be easily adjusted by adjusting the setting load of the spring member by externally deforming the wall surface after the installation of the housing parts.

BRIEF DESCRIPTION OF THE DRAWINGS

Additional objects and advantages of the present invention will be more readily apparent from the following detailed description of preferred embodiments thereof when taken together with the accompanying drawings in which:

FIG. 4A illustrates the valve element in the valve open position, and FIG. 4B illustrates the valve element in the valve closed position;

FIG. 6A is a top view and FIG. 6B is a front view;

FIG. 13A is a top view and FIG. 13B is a cross sectional view;

FIG. 14A is a top view and FIG. 14B is a cross sectional view;

FIG. 17A is a top view and FIG. 17B is a cross sectional view.

DETAILED DESCRIPTION OF THE PREFERRED EMBODIMENTS

Embodiments of the present invention will be described.

Figure 1:
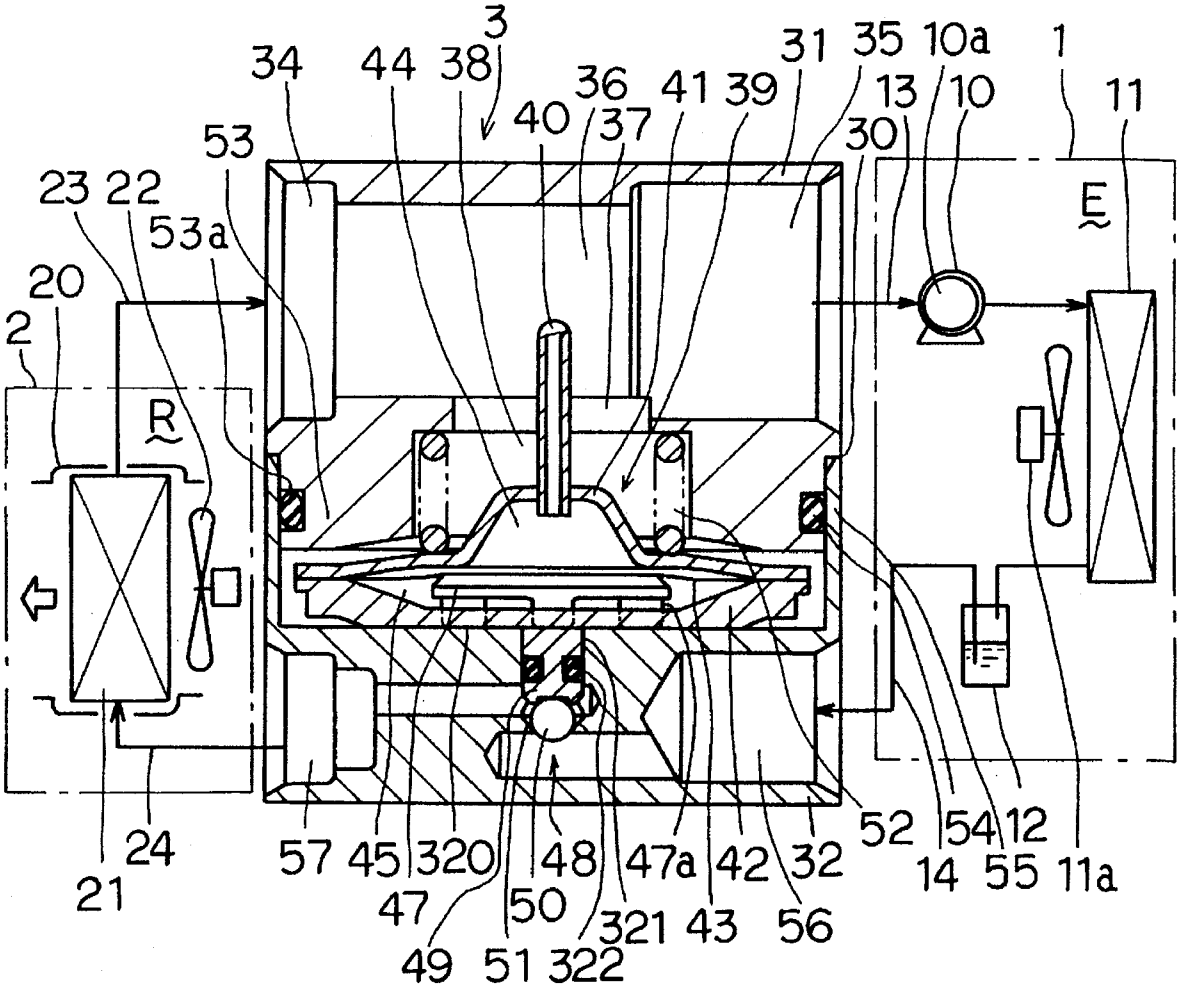
FIG. 1 is a cross sectional view of a thermal expansion valve including a construction of refrigerating cycle according to a first embodiment of the present invention.
Figure 2:
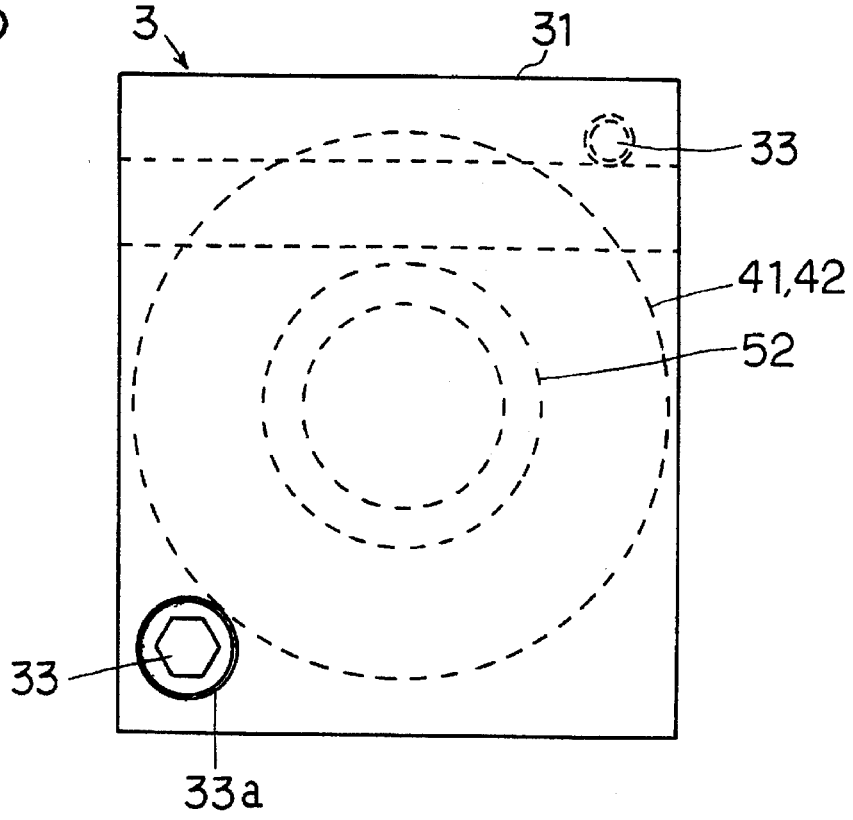
FIG. 2 is a top view of the thermal expansion valve of FIG. 1.

A first embodiment of the present invention is described with reference to FIGS. 1 through 4. FIG. 1 illustrates the entire construction of a refrigerating cycle for an automotive air conditioning system to which a thermal expansion valve according to the present invention is applied. The refrigerating cycle equipments for the air conditioning system in this embodiment mainly includes a condensing equipment group 1 installed within an automotive engine room E, a cooling unit 2 installed within an automotive compartment R, and a thermal expansion valve 3 installed within a dashboard (not illustrated) for partitioning the engine room E and the automotive compartment R and also for serving as a connecting member connecting refrigerant piping on the engine room side to that on the automotive compartment side.

The condensing equipment group 1 inclines a compressor 10 driven by an automotive engine, a condenser 11 for cooling and condensing the refrigerant gas discharged from the compressor 10, a liquid receiver 12 for accumulating the condensed refrigerant from the condenser 11 and for leading out only the liquid refrigerant downwardly, and other components, as known. The operation of the compressor 10 is turned ON and OFF by an electromagnetic clutch 10*a*. The condenser 11 is cooled by cooling the air blown from a cooling fan 11*a*.

The cooling unit 2 has a resin cooling unit case 20 for the automotive air conditioning system and a built-in evaporator 21 within this case 20 to cool and dehumidify the air sucked from inside/outside air selector box (not illustrated) of the automotive air conditioning system and blown by an air conditioning blower 22.

On the air downstream side of the cooling unit 2, a hot water type heater unit, an air outlet selector mechanism, various air outlets, etc. are provided, as known.

Figure 3:
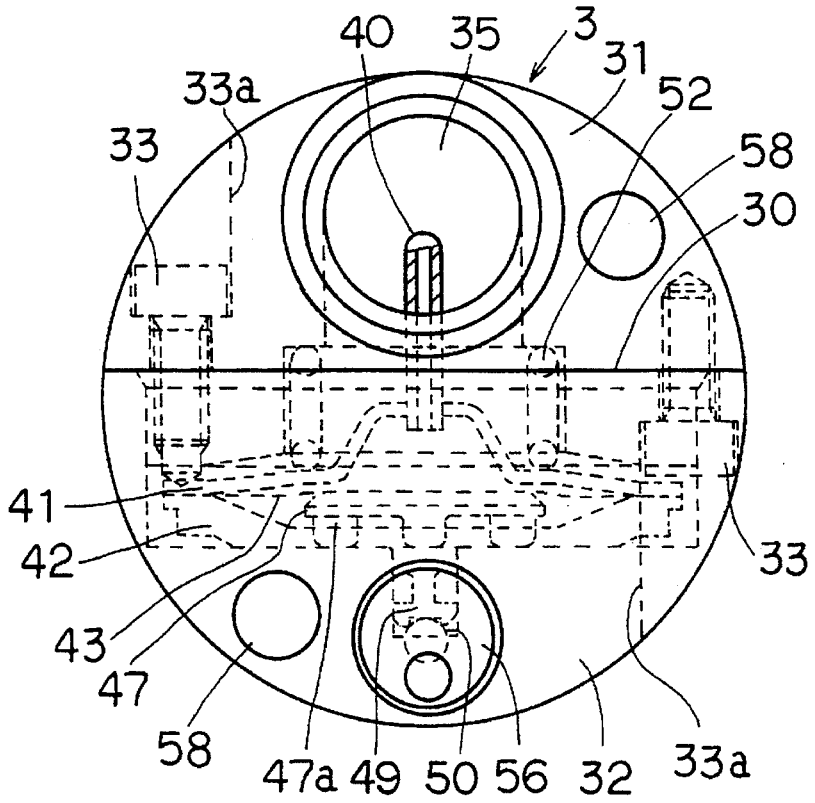
FIG. 3 is a front view of the thermal expansion valve of FIG. 1.

The main portion of the present invention relates to the thermal expansion valve 3. Now, the construction of the thermal expansion valve 3 will specifically be described. A housing for housing the internal mechanism of the expansion valve 3 includes two housings: a first housing 31 and a second housing 32. Both the housings 31 and 32 are made of a metal which is light in weight and high in resistance to corrosion like aluminum. As illustrated in FIG. 3, the housings 31 and 32 are divided into two parts in the axial direction of a cylindrical shape.

In the first embodiment, the cylindrical housing is divided not in the exactly intermediate position but eccentrically in the upper position such that the first housing 31 is smaller than the second housing 32. In FIG. 3, the reference numeral 30 denotes a divided surface between the first housing 31 and the second housing 32.

The first housing 31 and the second housing 32 are integrally and detachably screwed up to each other with two pieces of bolts 33 and 33. Here, in order for the bolts 33 and 33 to be inserted so closely that the sockets thereof can reach the proximity of the divided surface 30, bolt hole 33*a* is provided in each of the housings 31 and 32.

In the end surface of the first housing 31 on the side of the automotive compartment R, a first refrigerant inflow hole 34 is provided to permit the refrigerant from an exit-side low-pressure refrigerant circuit 23 of the evaporator 21 to flow into the first housing 31. On the other hand, in the end surface of the first housing 31 on the side of the engine room E, a first refrigerant outflow hole 35 is provided to permit the refrigerant from the exit of the evaporator 21 to flow out of the first housing 31. The first refrigerant outflow hole 35 is connected to a suction-side refrigerant circuit 13 of the compressor 10.

Between the first refrigerant inflow hole 34 and the first refrigerant outflow hole 35, a low-pressure side refrigerant passage 36 is formed to connect both the first refrigerant inflow hole 34 and the first refrigerant outflow hole 35 to each other.

Within the first housing 31, a thermosensitive element chamber 38 is formed so as to be communicated with the low-pressure side refrigerant passage 36 through a communication hole 37. This thermosensitive element chamber 38 is positioned on the side of the divided surface 30 within the first housing 31. Within the thermosensitive element chamber 38, a thermosensitive element 39 of the expansion valve 3 is movably disposed.

The thermosensitive element 39 includes refrigerant gas sealing cylinder 40 made of a copper type metal or the like. In addition, the thermosensitive element 39 includes a metallic diaphragm case 41 to which the refrigerant gas sealing cylinder 40 is integrally brazed, another metallic diaphragm case 42 in coupling with the diaphragm case 41, and a metallic diaphragm 43 fixedly held between both the metallic diaphragm cases 41 and 42. These members 41 through 43 are formed with a metal which has a high corrosion resistance, such as a stainless steel, and integrally welded to each other.

The refrigerant gas sealing cylinder 40 opens at an end to a thermosensitive chamber 44 formed with the diaphragm case 41 and the diaphragm 43. Within the closed inner space formed with the thermosensitive chamber 44 and the refrigerant gas sealing cylinder 40, the same refrigerant as that circulating in the refrigerating cycle of the air conditioning system is filled. Therefore, the inner pressure of the thermosensitive chamber 44 is saturation pressure according to the ambient refrigerant temperature.

More specifically, the temperature of the refrigerant flowing through the low-pressure side refrigerant passage 36 transmits to the refrigerant within the thermosensitive chamber 44 through the refrigerant filled in the thermosensitive element chamber 38 around the thermosensitive chamber 44. When the temperature of the refrigerant flowing through the low-pressure side refrigerant passage 36 falls, the refrigerant within the thermosensitive chamber 44 condenses, thereby lowering the refrigerant pressure. On the other hand, when the temperature of the refrigerant flowing through the low-pressure side refrigerant passage 36 rises, the refrigerant in the liquid phase within the thermosensitive chamber 44 evaporates, thereby raising the refrigerant pressure. In this way, the pressure within the thermosensitive chamber 44 maintains to be saturation pressure according to the temperature of the refrigerant flowing through the low-pressure side refrigerant passage 36.

Figure 4A:
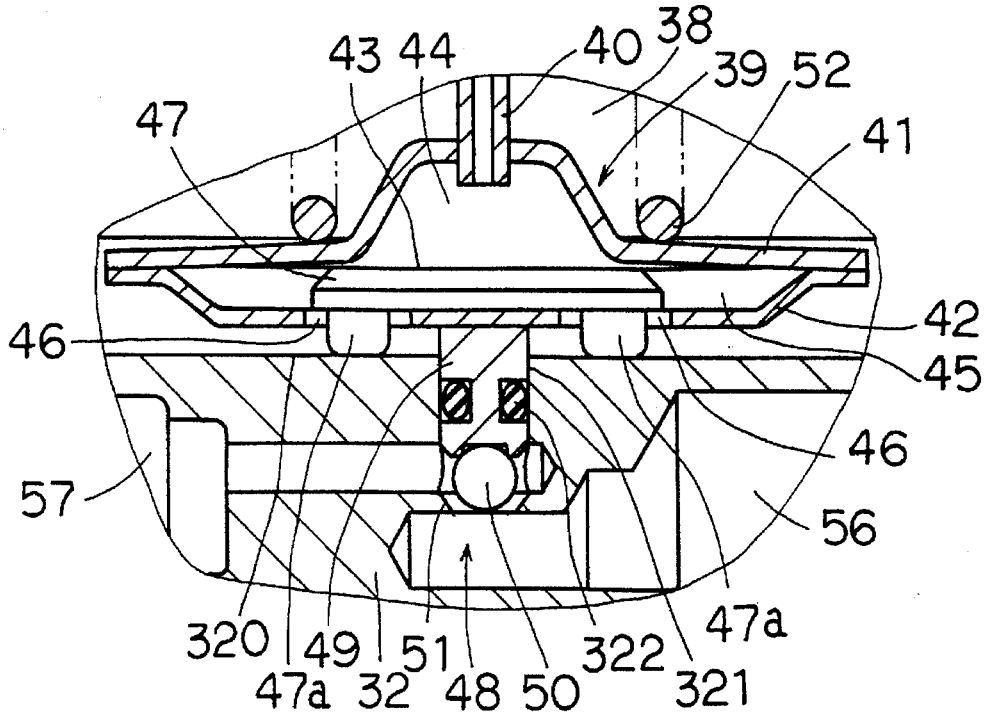
FIGS. 4A and 4B are enlarged cross-sectional views of a main portion of the thermal expansion valve of FIG. 1.
Figure 4B:
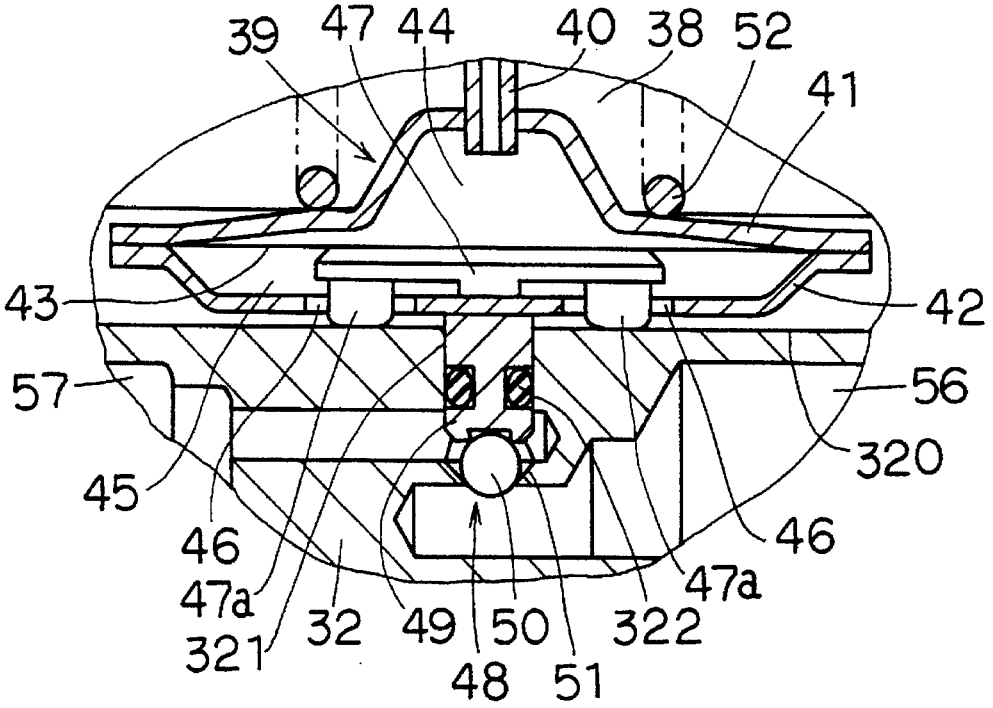

Furthermore, the refrigerant pressure (i.e., the refrigerant pressure on the exit side of the evaporator 21) of the thermosensitive element chamber 38 is introduced into a pressure chamber 45 formed with the diaphragm case 42 and the diaphragm 43 through a through hole 46 provided in the diaphragm case 42 as shown in FIG. 4.

Within the pressure chamber 45, a contacting member 47, which displaces according to the displacement of the diaphragm 43, is disposed. The contacting member 47 is formed like a disk with a metal, such as aluminum, in such a way that a surface (the top) of the disk part can be in contact with the diaphragm 43.

A plurality of cylindrical leg portions 47*a* (in this embodiment, three leg portions) integrally extend from the other surface (the bottom) of the disk part of the contacting member 47.

As illustrated in FIG. 4, the through hole 46 in the diaphragm case 42 is formed in such a manner that the cylindrical leg portions 47*a* is slidably disposed therein, and the ends (the bottoms) of the cylindrical leg portions 47*a* of the contacting member 47 is so formed as to be in contact with a circular flat surface 320 of the second housing 32 facing the diaphragm case 42 (the surface forming a part of the thermosensitive element chamber 38).

To be more specific, the cylindrical leg portions 47*a* of the contacting member 47 are so set in length as to contact the circular surface 320 at the ends thereof before the diaphragm case 42 comes to contact the circular surface 320 (FIG. 4).

On the other hand, a second refrigerant inflow hole 56 is formed in the end surface of the second housing 32 on the side of the engine room E to permit the refrigerant from a high-pressure side refrigerant circuit 14 connected to the downstream side of the liquid receiver 12 to flow into the second housing 32. The inflow refrigerant passes through a throttle passage 51, the opening degree of which being adjusted by a valve element 50 of an expansion mechanism 48, thereby being decompressed and expanding into the vapor-liquid two-phase state.

A second refrigerant outflow hole 57 is formed in the end surface on the side of the automotive compartment R to permit the refrigerant in the vapor-liquid two-phase state to flow out thereof. This second refrigerant outflow hole 57 is connected to an entrance side low-pressure refrigerant circuit 24 of the evaporator 21.

The valve element 50 is made of a metal such as stainless steel, in the shape of a ball. An end of a valve stem 49 made of a metal such as stainless steel is integrally connected to the valve element 50 by means of welding or otherwise. The other end of the valve stem 49 is integrally connected to the diaphragm case 42 by means of welding, crimping or otherwise.

Here, the diaphragm case 42 and the valve stem 49 may be integrally formed as a single piece of parts by machining instead of a structure where two separate parts are integrally connected.

The valve stem 49 is slidably disposed in a hole 321 provided in the second housing 32, and the sliding part of the valve stem 49 and hole 321 is provided with an O-ring (an elastic sealing member) 322 for maintaining airtightness therebetween.

As illustrated in FIG. 1, the part of the thermosensitive element 39 around the diaphragm cases 41 and 42 is disposed between the inner wall surface of the first housing 31 and the second housing 32, and a coil spring 52 made of a metallic spring material is disposed between the first housing 31 and the upper diaphragm case 41.

Accordingly, when the first housing 31 and the second housing 32 are assembled, the coil spring 52 is elastically compressed and deformed by the fastening forces of the bolts 33 and 33, and the spring force of the coil spring 52 generated by the elastic compression and deformation acts on the parts of the diaphragm cases 41 and 42, thereby pressing the thermosensitive element 39 downwardly in FIG. 1.

This downward pressing force acting on the thermosensitive element 39 acts on the valve element 50 in the valve opening direction (the direction in which the opening degree of the throttle passage 51 decreases).

A protrusion portion 53 annularly protruding toward the second housing 32 is integrally formed with the first housing 31. The outer circumferential surface of the protrusion portion 53 is formed an annular groove 53*a*, and O-ring 54 is fitted within the annular groove 53*a*. On the other hand, a protrusion portion 55 having an annular inner circumferential surface to which the outer circumferential surface of the protrusion portion 53 is fitted is integrally formed with the second housing 32. With a combination of the fitting structures of the protrusion portions 53 and 55 and the O-ring 54, the interface between the first housing 31 and the second housing 32 is sealed.

Here, the refrigerant holes 34 and 35 of the first housing 31 and the refrigerant holes 56 and 57 of the second housings 32 are formed into circular stepwise holes to fittingly receive the respective connection piping parts of pipe joint members (not illustrated), where the pipe joint members are detachably screwed up to the first housing 31 and the second housing 32 respectively by fixing bolts (not illustrated). In screw holes 58 illustrated in FIG. 3, the fixing bolts for the pipe joint members are screwed up respectively.

Next, an operation of the present invention is described as to the construction described above.

Gas refrigerant evaporated by the evaporator 21 in the cooling unit 2 passes through the exit-side low-pressure refrigerant circuit 23 and flows into the low-pressure side refrigerant passage 36 from the refrigerant inflow hole 34 in the first housing 31, and then passes through this passage 36. At this time, the temperature of the refrigerant passing through the low-pressure side refrigerant passage 36 transmits to the thermosensitive chamber 44 through the communication hole 37 and the thermosensitive element chamber 38, and as a result, the pressure in the thermosensitive chamber 44 is controlled according to the transmitted refrigerant temperature.

On the other hand, the refrigerant pressure of the low-pressure side refrigerant passage 36 from the thermosensitive chamber 38 through the through hole 46 is introduced into the pressure chamber 45 below the diaphragm 43. When the refrigerant temperature of the low-pressure side refrigerant passage 36 rises and then the pressure in the thermosensitive chamber 44 rises accordingly, the diaphragm 43 downwardly presses the top of the contacting member 47 in FIG. 1.

However, as the leg portions 47*a* of the contacting member 47 have already been in contact with the circular surface 320 of the second housing 32, the contacting member 47 can not move downwardly in FIG. 1. Then, as the leg portions 47*a* of the contacting member 47 are slidably fitted in the through hole 46 in the diaphragm case 42, the "pressing force from the diaphragm 43 on the contacting member 47" generated by the increase in the pressure of the thermosensitive chamber 44 acts as a force upwardly levering the entirety of the thermosensitive element 39 in FIG. 1 utilizing the respective portions of the leg portions 47*a* of the contacting member 47 in contact with the circular surface 320 of the second housing 32 as fulcrums.

As the thermosensitive element 39 is applied pressure in the downward direction in FIG. 1 by the coil spring 52, the upward movement of the thermosensitive element 39 in FIG. 1 compresses the coil spring 52 and increases the spring force of the coil spring 52. The thermosensitive element 39 keeps on moving upwardly in FIG. 1 until the spring force of the coil spring 52 and the "pressing force from the diaphragm 43 on the contacting member 47" come to be in balance with each other.

As the valve element 50 is integrally connected to the diaphragm case 42 below the thermosensitive element 39 through the valve stem 49, the valve stem 49 and the valve element 50 move together with the thermosensitive element 39. In this way, the valve element 50 increases the opening degree of the throttle passage 51 by the upward movement thereof. As a result, the refrigerant flow rate through the throttle passage 51 increases, and the overheat of the gas refrigerant at the exit of the evaporator 21 is maintained to a specified level.

On the other hand, when the refrigerant temperature of the low-pressure side refrigerant passage 36 falls and then the pressure in the thermosensitive chamber 44 falls accordingly, the "pressing force from the diaphragm 43 on the contacting member 47" decreases, and thereby the entirety of the thermosensitive element 39 is downwardly pressed in FIG. 1 by the spring force of the coil spring 52. As a result, the valve element 50 decreases the opening degree of the throttle passage 51.

The target overheat of the gas refrigerant at the exit of the evaporator 21 can be altered by adjusting the spring force of the coil spring 52.

As described above, the movement of the thermosensitive element 39 together with the valve element 50 adjusts the opening degree of the throttle passage 51, thus maintaining the refrigerant overheat at the exit of the evaporator 21 to a specified level which is set by the spring force of the coil spring 52.

FIG. 4(*a*) illustrates the valve open state in which the top of the lower diaphragm case 42 is in contact with the bottom of the contacting member 47 and thus the movement of the thermosensitive element 39 is stopped, while FIG. 4(*b*) illustrates the valve closed state in which the ball-shaped valve element 50 is in contact with the inner wall surface of the cone-shaped throttle passage 51.

It should be noted here that when passing through the throttle passage 51, the refrigerant is rapidly decompressed and consequent expands, and under the influence of the flow of the refrigerant, vibration is caused to the valve element 50. According to the first embodiment of the present invention, however, as described above, the diaphragm cases 41 and 42 of the thermosensitive element 39 are not fixed to the respective sides of the first and second housings 31 and 32 but the entirety of the thermosensitive element 39 is made movable against the first and second housings 31 and 32, and the valve element 50 is displaced to adjust the opening degree of the throttle passage 51 by the movement of the entirety of the thermosensitive element 39. Therefore, there is little possibility that the vibration of the valve element 50 transmits from the valve stem 49 to the respective sides of the first and second housings 31 and 32 through the respective diaphragm cases 41 and 42 of the thermosensitive element 39.

Furthermore, as there is a minute clearance between the valves stem 49 and the hole 321 in the housing 32, there is little possibility that the vibration of the valve element 50 transmits from the valve stem 49 to the second housing 32. Therefore, the generation of the noise caused by the vibration of the valve element 50 can be greatly reduced.

Moreover, according to the present invention, the housing of the thermal expansion valve 3 is divided into two housings, the first housing 31 and the second housing 32, and the thermosensitive element 39 is incorporated therebetween. Therefore, there is no need to provide a lid having a sealing mechanism on the top of the housing unlike the conventional structure, and the height of the thermal expansion valve 3 can greatly be reduced as compared with the conventional structure.

In addition, according to the first embodiment of the present invention, the refrigerant inflow hole 34 and refrigerant outflow hole 35 having shapes for pipe connection are provided in such a manner to lay on the diaphragm cases 41 and 42 of the thermosensitive element 39. Therefore, the width of the housing can be greatly shortened.

Still furthermore, according to the first embodiment of the present invention, as the low-pressure side refrigerant passage 36 is communicated with the thermosensitive element chamber 38, where the thermosensitive element 39 is disposed, through the communication hole 37, the refrigerant temperature within the thermosensitive chamber 44 of the thermosensitive element 39 changes slightly behind the change in the refrigerant temperature within the low-pressure side refrigerant passage 36. Therefore, the response of the pressure change of the refrigerant gas within the thermosensitive chamber 44 is also slightly behind the change in the refrigerant temperature within the low-pressure side refrigerant passage 36, and the thermal expansion valve 3 can have a responsibility which is proper enough to prevent the hunching of the refrigerating cycle.

Here, as the diameter (the cross-sectional area) or shape of the communication hole 37 can freely be adjusted or altered, the responsibility of the thermosensitive element 39, which have an influence on the stability of the refrigerating cycle, can be easily adjusted by adjusting or altering the diameter (the cross-sectional area) or shape of the communication hole 37.

A second embodiment of the present invention is described.

Figure 5:
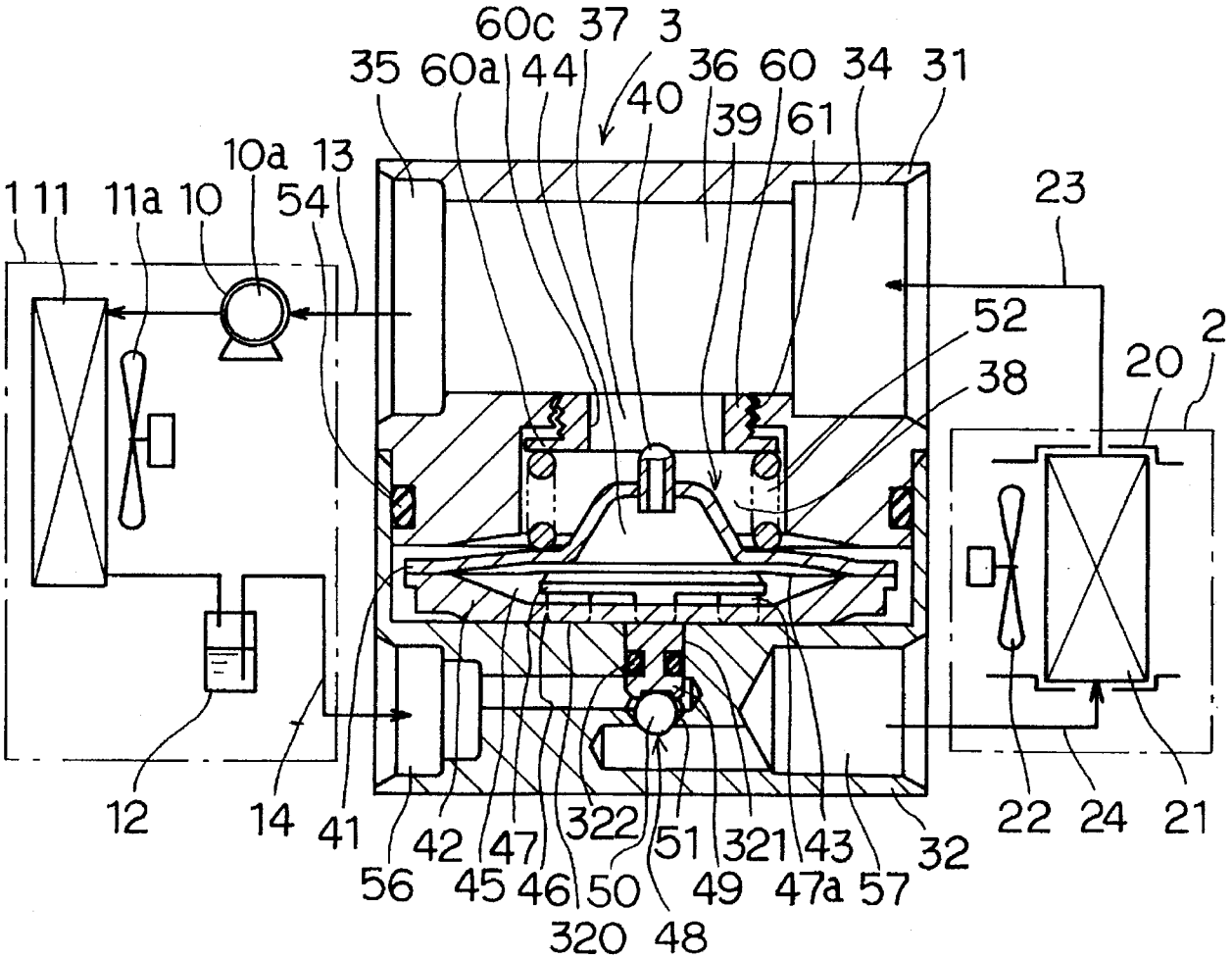
FIG. 5 is a cross sectional view of a thermal expansion valve including a construction of refrigerating cycle according to a second embodiment.
Figure 6A:
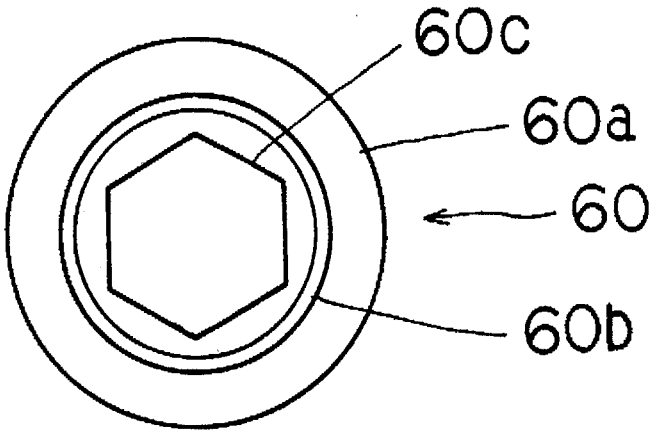
FIGS. 6A and 6B are views of an adjusting screw in the second embodiment of the present invention.
Figure 6B:
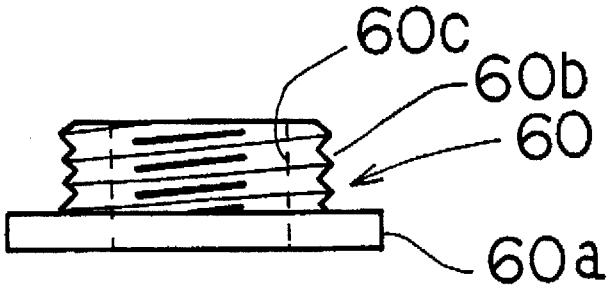

FIGS. 5 and 6 illustrate the second embodiment according to the present invention. In this embodiment, the spring force of the coil spring 52 can be adjusted after the thermal expansion valve is assembled. For this purpose, an adjusting screw 60 is provided on an end (an upper end) side of the coil spring 52.

The adjusting screw 60 is formed to have a spring holding surface 60*a* of flange (disk) shape, a male thread portion 60*b* slightly smaller in outside diameter than the spring holding surface 60*a*, and a hexagonal tool hole 60*c*. The tool hole 60*c* also serves to form the communication hole 37.

The male thread portion 60*b* of the adjusting screw 60 is screwed up to a female thread portion 61 formed on the part of the communication hole 37. After the thermal expansion valve 3 is assembled, the spring force of the coil spring 52 can be adjusted by inserting a tool (not illustrated) into the tool hole 60*c* of the adjusting screw 60 and adjusting the screw-up position of the adjusting screw 60.

A third embodiment of the present invention is described.

Figure 7:
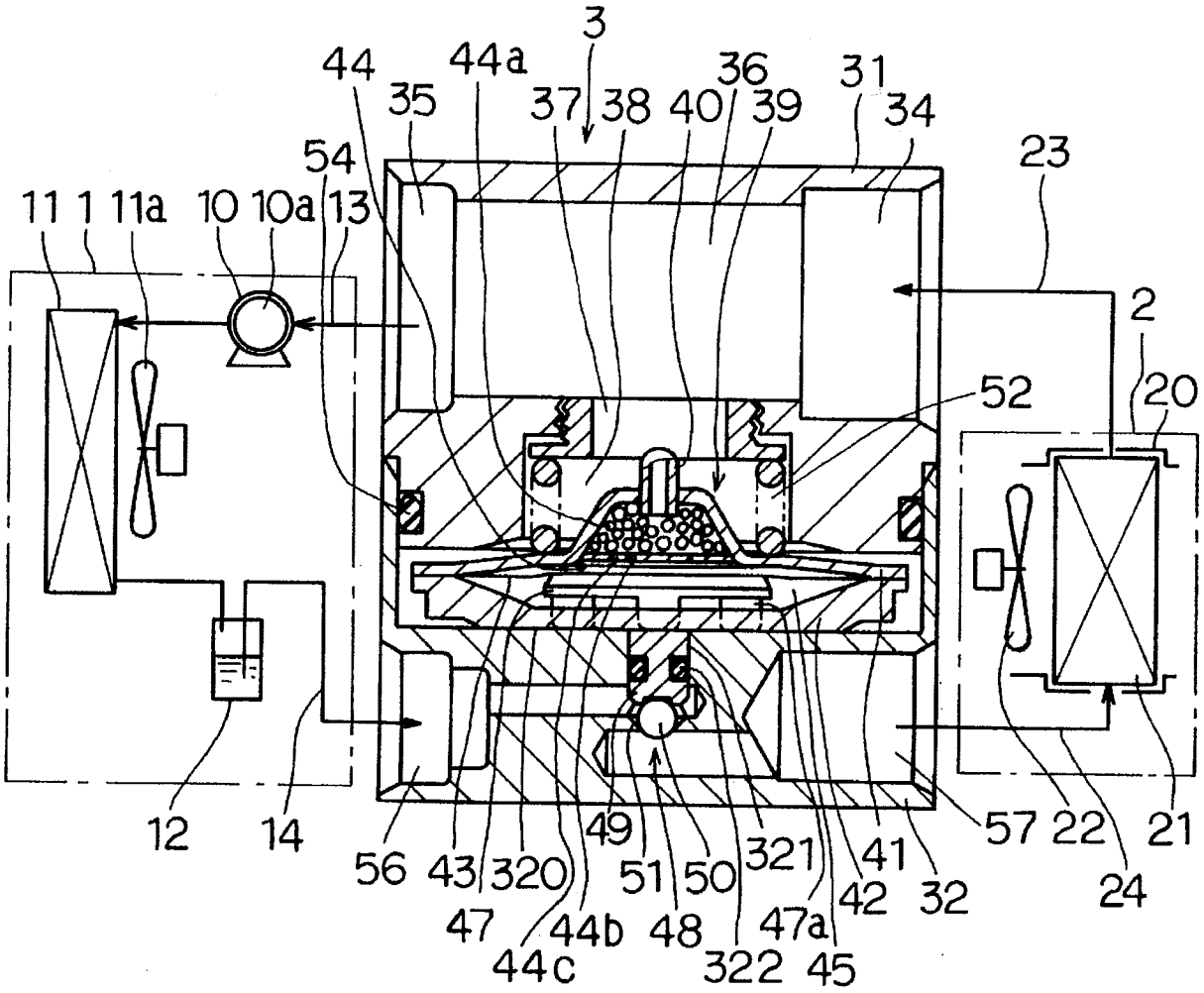
FIG. 7 is a cross sectional view of a thermal expansion valve including a construction of refrigerating cycle according to a third embodiment.

FIG. 7 illustrates the third embodiment of the present invention with a modification to the thermosensitive element 39. In this embodiment, adsorbent 44*a* made of granular active carbon is accommodated in the upper space within the thermosensitive chamber 44, and the adsorbent 44*a* is held by an adsorbent guide 44*b*. The adsorbent guide 44*b* is fixed to the diaphragm case 41. The adsorbent guide 44*b* has a plurality of slits 44*c* through which the refrigerant gas within the thermosensitive chamber 44 can enter the space on the side of the adsorbent 44*a* and exit therefrom.

In this embodiment, according to the refrigerant temperature detected within the thermosensitive chamber 44, the rate of the adsorption of the refrigerant gas to the adsorbent 44*a* changes, and according thereto the pressure within the thermosensitive chamber 44 changes. The present invention can be applied to such adsorption charge type as well.

A fourth embodiment of the present invention is described.

Figure 8:
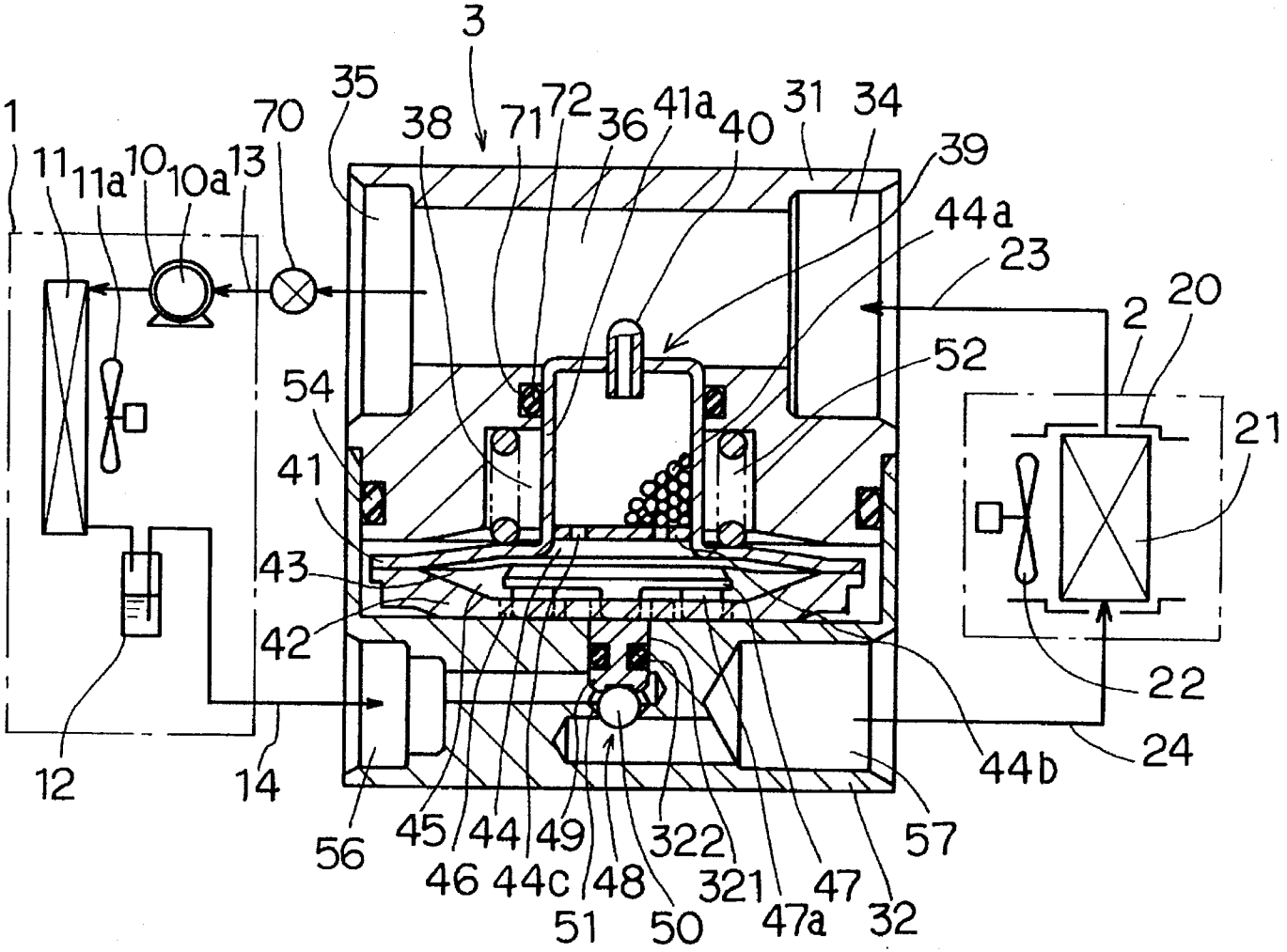
FIG. 8 is a cross sectional view of a thermal expansion valve including a construction of refrigerating cycle according to a fourth embodiment.
Figure 9:
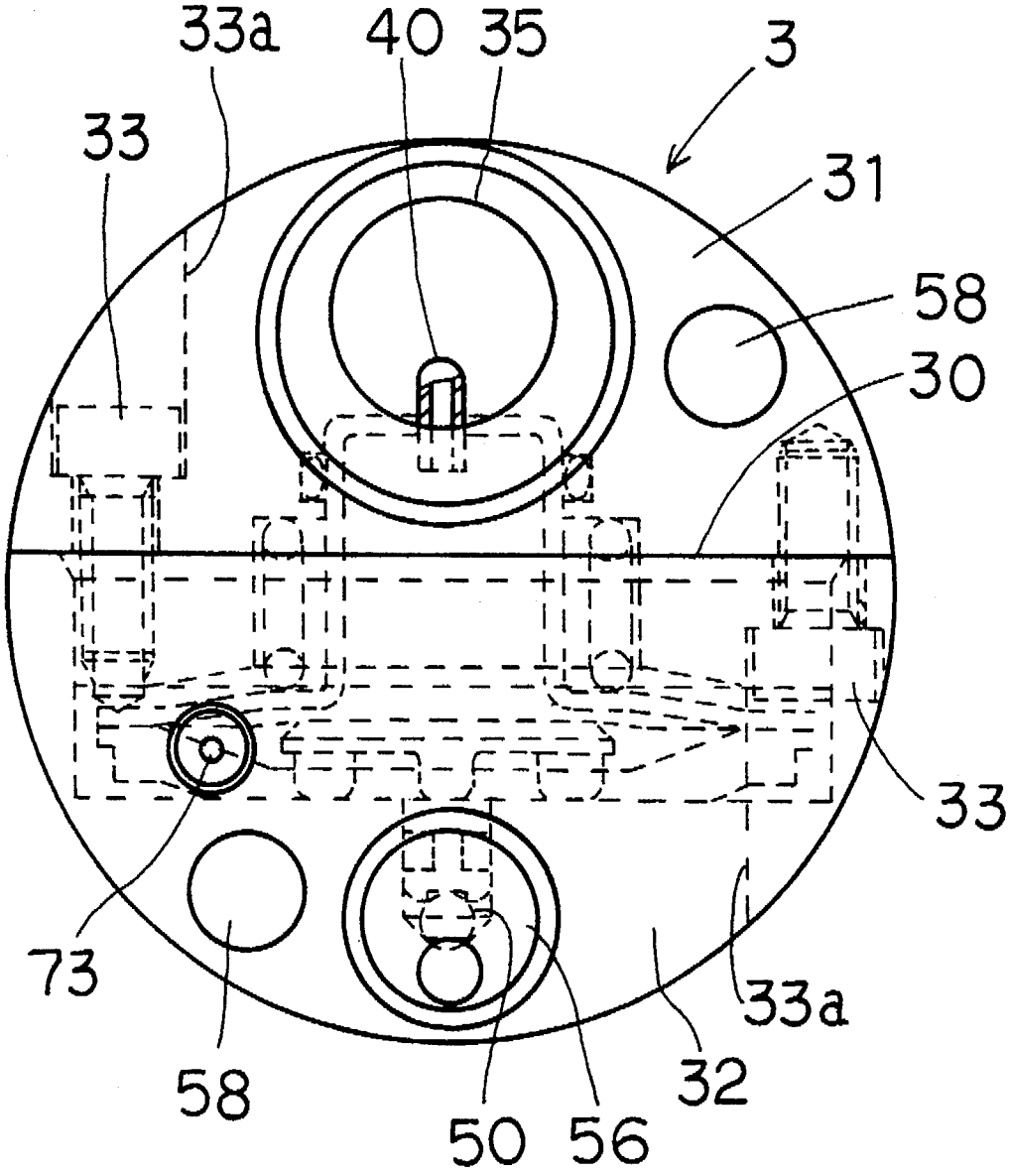
FIG. 9 is a front view of the thermal expansion valve of FIG. 8.

FIGS. 8 and 9 illustrate the fourth embodiment according to the present invention. In this embodiment, the present invention is applied to a refrigerating cycle having a vapor pressure adjusting valve (EPR) 70. As widely known, the vapor pressure adjusting valve 70 prevents frost on the evaporator 21 by adjusting the throttling degree of the exit-side low-pressure passage 23 of the evaporator 21 so that the vapor pressure of the evaporator 21 is maintained to a specified level or higher.

In the refrigerating cycle having the vapor pressure adjusting valve 70, the refrigerant pressure on the exit side of the vapor pressure adjusting valve 70 is introduced into the pressure chamber 45 located below the diaphragm 43 of the thermosensitive element 39.

In the thermosensitive element 39, a cylindrical portion 41*a* is integrally formed in the central part of the upper side diaphragm case 41. Within the cylindrical portion 41*a*, the adsorbent 44*a* and the adsorbent guide 44*b* are disposed. In the inner wall surface of the first housing 31 facing the outer circumferential part of the cylinder part 41*a*, a groove 71 is provided. An O-ring (a sealing member) 72 is provided within the groove 71.

By press fitting the O-ring 72 to the outer circumferential part of the cylindrical portion 41*a*, the thermosensitive element chamber 38 is airtightly separated from the low-pressure side refrigerant passage 36. As the top of the cylindrical portion 41*a* of the upper side diaphragm case 41 directly faces the low-pressure side refrigerant passage 36, the temperature of the refrigerant flowing through the low-pressure side refrigerant passage 36 is transmitted to the cylindrical portion 41*a* of the upper side diaphragm case 41, and thereby the pressure within the thermosensitive chamber 44 changes.

On the other hand, in the second housing 32, a connection hole 73 (FIG. 9) is provided so as to connect a capillary tube (not illustrated) for introducing the refrigerant pressure on the exit side of the vapor pressure adjusting valve 70. The connection hole 73 is so formed as to communicate with the thermosensitive element chamber 38 around the diaphragms 41 and 42.

Therefore, the refrigerant pressure on the exit side of the vapor pressure adjusting valve 70 can be introduced from the capillary tube (not illustrated) into the pressure chamber 45 located below the diaphragms 41 and 42 through the connection hole 73, the thermosensitive element chamber 38 and the through hole 46.

In this way, when the refrigerating cycle is in a low load operating condition, the lower refrigerant pressure reduced by the vapor pressure adjusting valve 70 is introduced into the pressure chamber 45, and thereby the opening degree of the valve element 50 increases. Therefore, the deterioration of oil returning to the compressor 10 due to the throttling function of the vapor pressure adjusting valve 70 can be prevented.

A fifth embodiment of the present invention is described.

Figure 10:
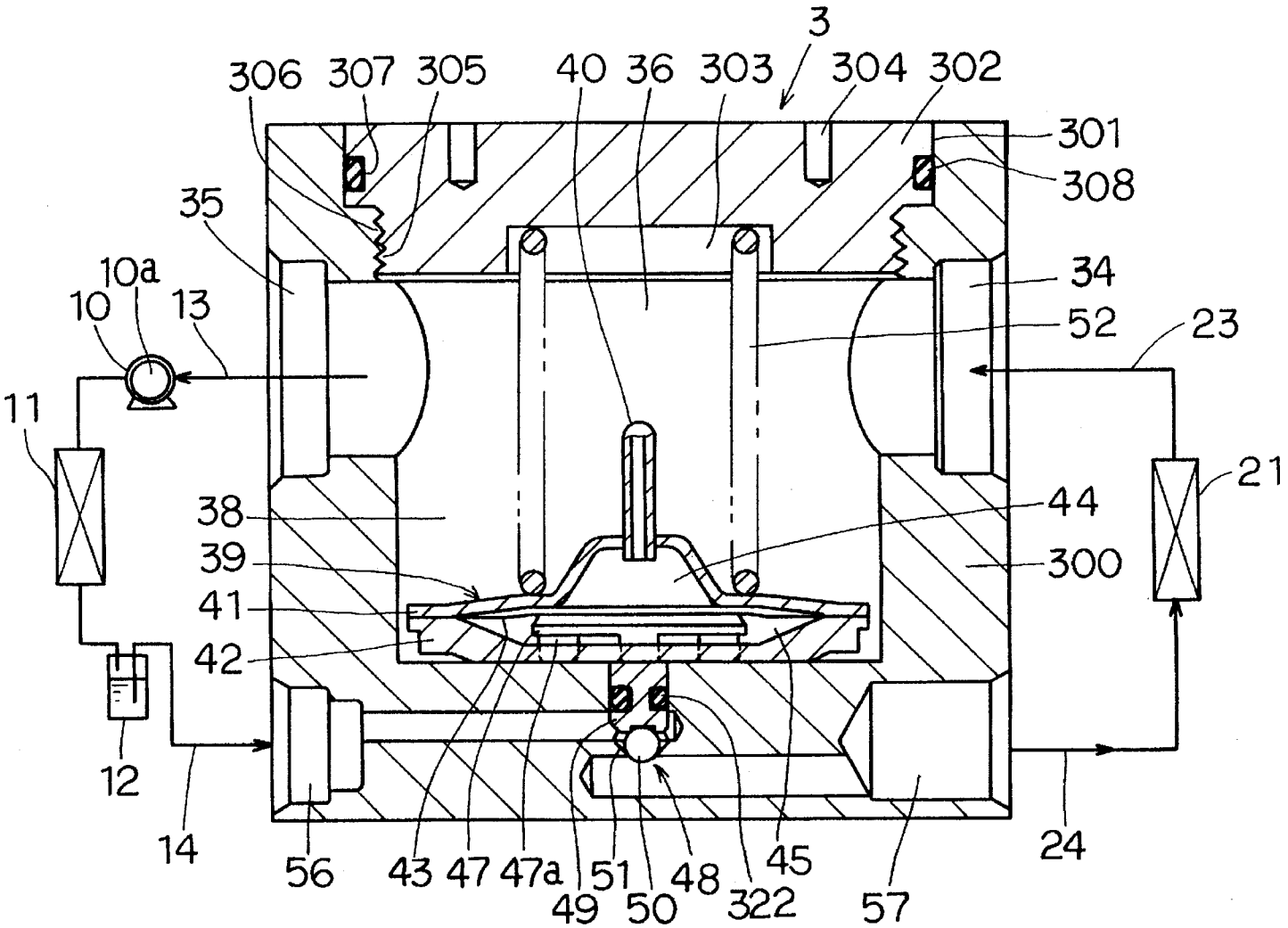
FIG. 10 is a sectional view of a thermal expansion valve including a construction of refrigerating cycle according to a fifth embodiment.

FIG. 10 illustrates the fifth embodiment of the present invention with a modification to the housing structure of the thermal expansion valve 3. In this embodiment, a housing body 300 is composed of a single cylindrical or square block, and an upper opening portion 301 of the housing body 300 is enclosed with a lid member 302.

On the bottom of the lid member 302, a circular recessed portion 303 for supporting the upper end of the coil spring 52 is formed, and on the top of the lid member 302, a groove for engaging a tool is formed. On the outer circumferential part of the smaller diameter portion of the lid member 302, a male thread 305 is formed. By screwing up the male thread 305 to a female thread 306 formed on the housing body 300, the lid member 302 is fixed to the housing body 300.

On the outer circumferential portion of the large diameter portion of the lid member 302, an annular groove 307 is formed. By fitting an O-ring 308 into this groove 307, the lid member 302 can airtightly be held with the housing body 300.

According to this embodiment, the lid member 302 also serves as an adjusting screw for adjusting the spring force of the coil spring 52. The diaphragm cases 41 and 42 are accommodated in the thermosensitive element chamber 38, and the thermosensitive element chamber 38 opens directly to the low-pressure side refrigerant passage 36 with the inner diameter made slightly larger than the respective outer diameters of the diaphragm cases 41 and 42. Furthermore, the inner diameter of the opening portion 301 is made slightly larger than the inner diameter of the thermosensitive element chamber 38.

A sixth embodiment of the present invention is described.

Figure 11:
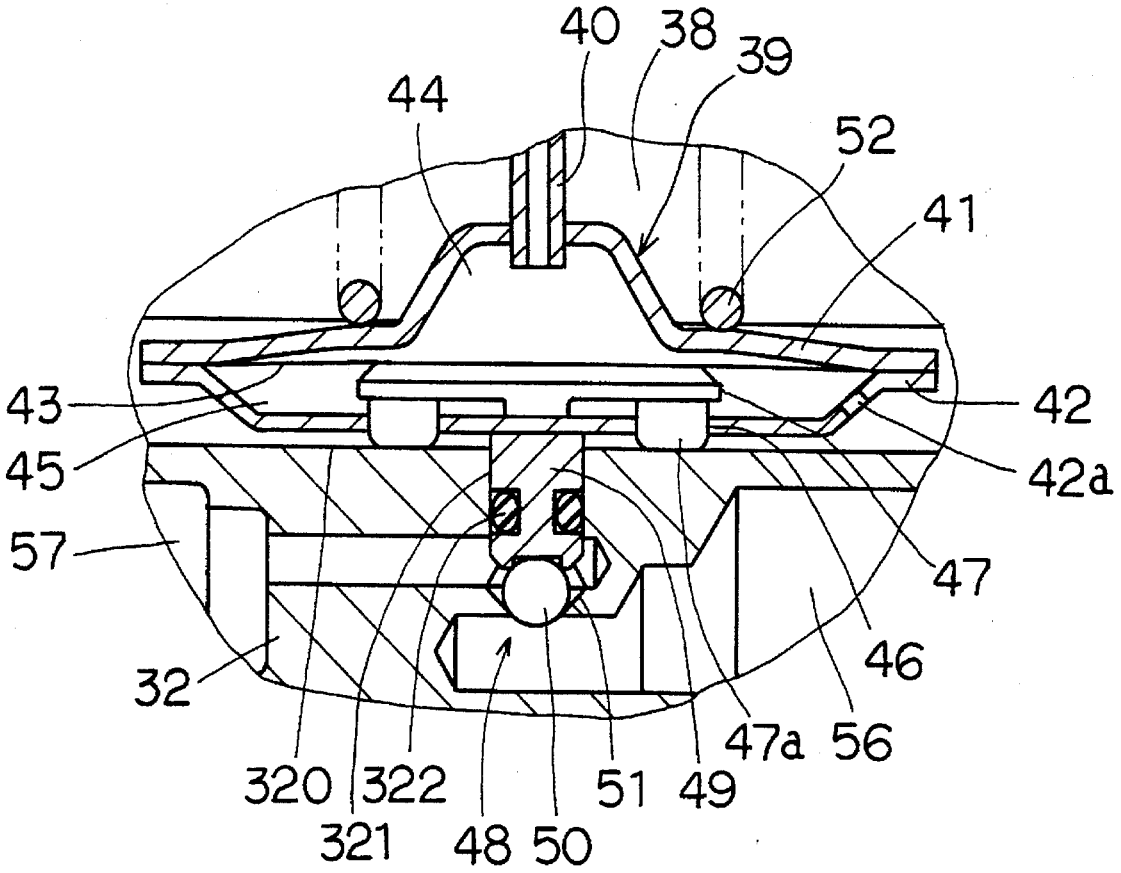
FIG. 11 is an enlarged sectional view of a main portion of a thermal expansion valve according to a sixth embodiment of the present invention.

FIG. 11 illustrates the sixth embodiment of the present invention with a modification to the communication structure of the pressure chamber 45 with the thermosensitive element chamber 38 within the thermosensitive chamber 39. According to this embodiment, the respective diameters of the through holes 46 in the diaphragm case 42 through which the respective leg portions 47*a* of the contacting member 47 penetrate are made smaller. In this structure, the function of the through holes 46 for communicating the pressure chamber 45 with the thermosensitive element chamber 38 is removed, and a specific communication hole 42*a* is provided in the diaphragm case 42 to communicate the pressure chamber 45 with the thermosensitive element chamber 38. It is needless to say that the same operation and effect can be achieved according to this structure.

A seventh embodiment of the present invention is described.

Figure 12:
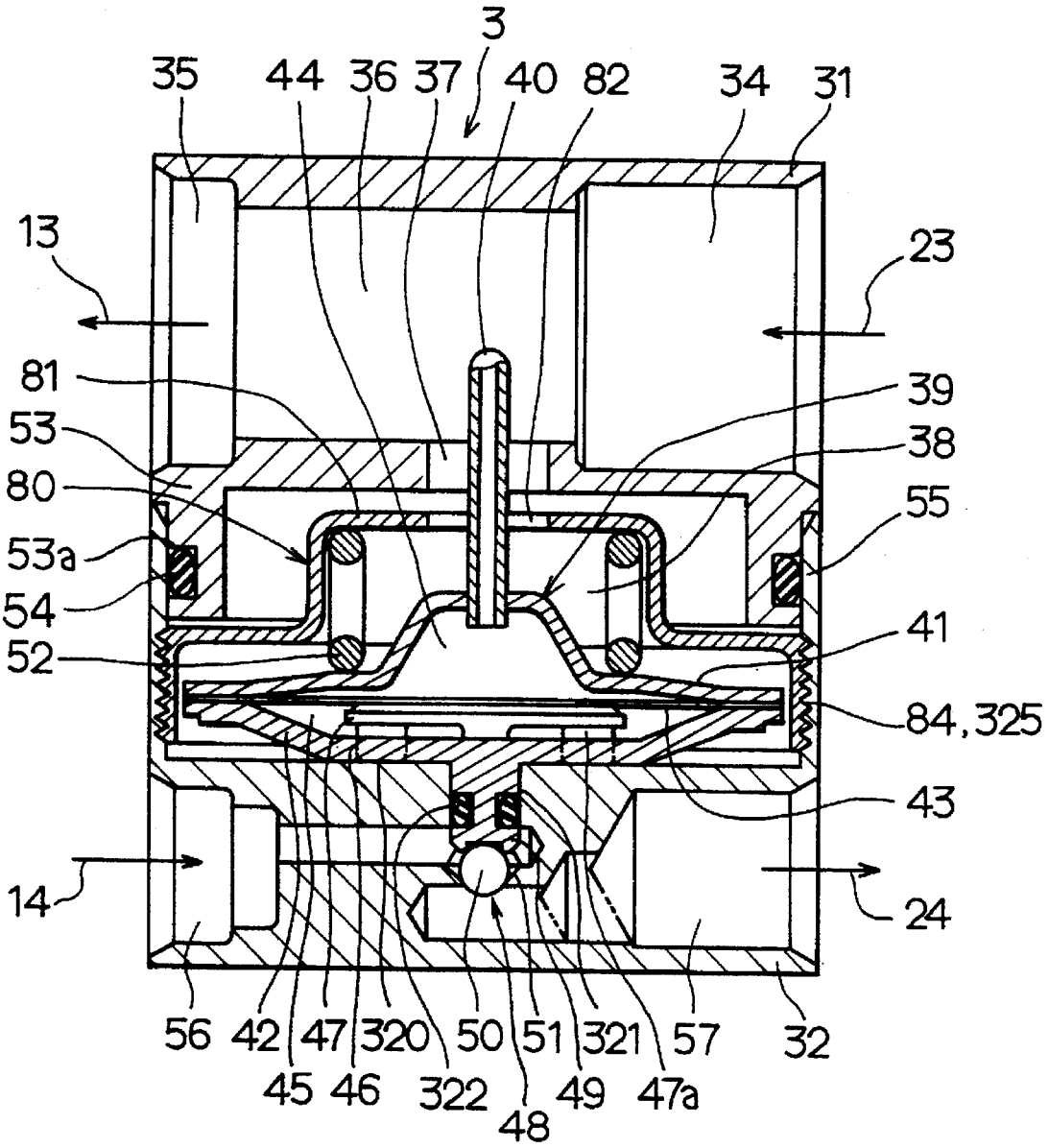
FIG. 12 is an enlarged sectional view of a main portion of a thermal expansion valve according to a seventh embodiment of the present invention.
Figure 13A:
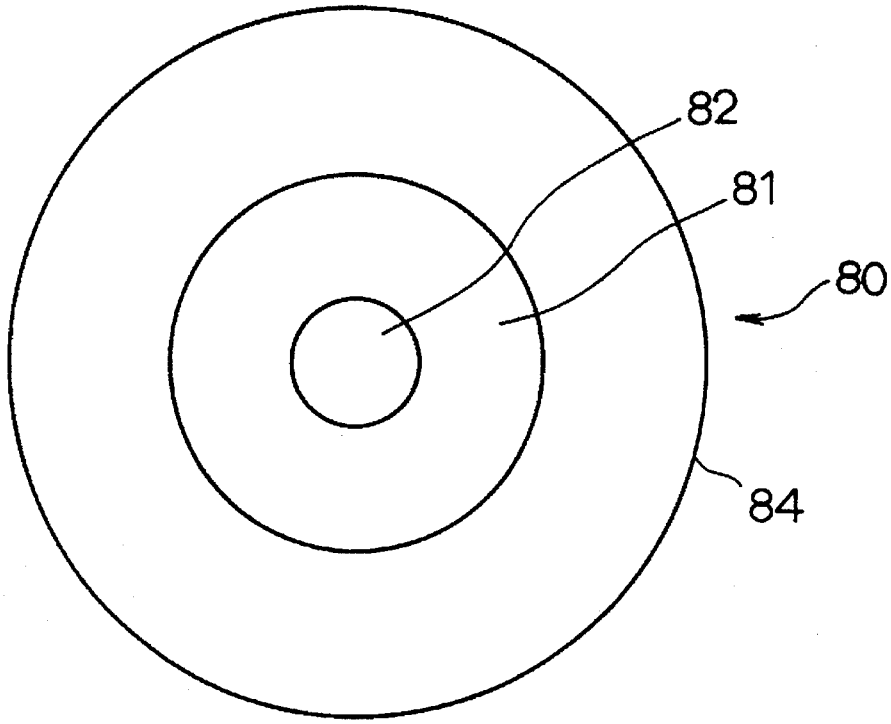
FIGS. 13A and 13B are views of an adjusting screw according to the seventh embodiment.
Figure 13B:
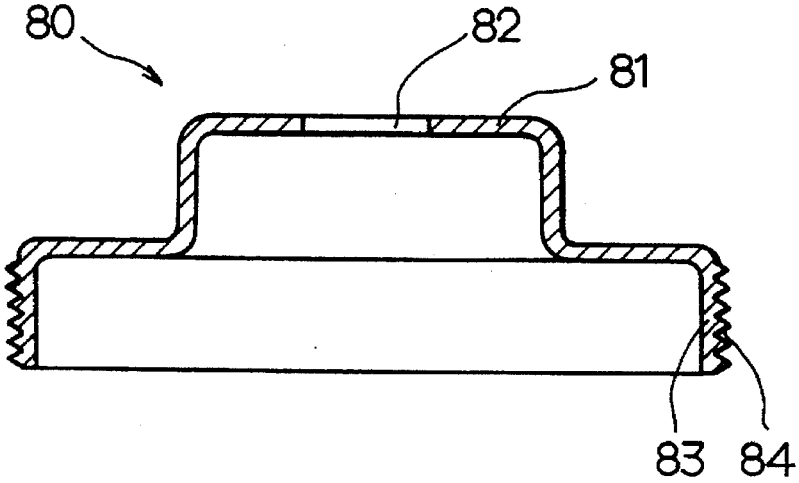

The seventh embodiment relates to a mechanism for adjusting the spring force of the coil spring 52. In this embodiment, as illustrated in FIG. 12, an adjusting screw 80 is provided with a modification to the adjusting screw 60 of the second embodiment. As illustrated in FIG. 13, the adjusting screw 80 according to this embodiment is formed by pressing into a two-steps bowl shape by curving a metal having a high corrosion resistance, such as stainless steel.

In the central portion of a bottom portion 81 of the bowl-shaped adjusting screw 80, a circular hole 82 is provided to communicate the low-pressure side refrigerant passage 36 with the thermosensitive element chamber 38 through the circular hole 82. Also the adjusting screw 80 supports an end (the upper end) of the spring coil on the inside surface of the bottom 81.

The large diameter cylinder surface 83 of the adjusting screw 80 fits the inner circumferential surface of the second housing 32. On the outer circumferential surface of the larger diameter cylinder surface 83, a male thread 84 is formed, while on the inner circumferential surface of the second housing 32, a female thread 325, which engages with the male thread 84 formed on the outer circumferential surface of the larger diameter cylinder surface 83, is formed.

According to the structure of the seventh embodiment, it is possible to dispose the coil spring 52 with respect to the thermosensitive element 39 after the thermosensitive element 39 is assembled into the second housing 32 and then to adjust the setting load of the coil spring 52 by screwing up the adjusting screw 80 to the female thread 325 on the inner circumferential surface of the second housing 32 while pressing an end of the coil spring 52, thereby adjusting the position of an end (the top) of the coil spring 52.

After the setting load of the coil spring 52 is adjusted by the adjusting screw 80, the first housing 31 is coupled with the second housing 32.

An eighth embodiment of the present invention is described.

Figure 14A:
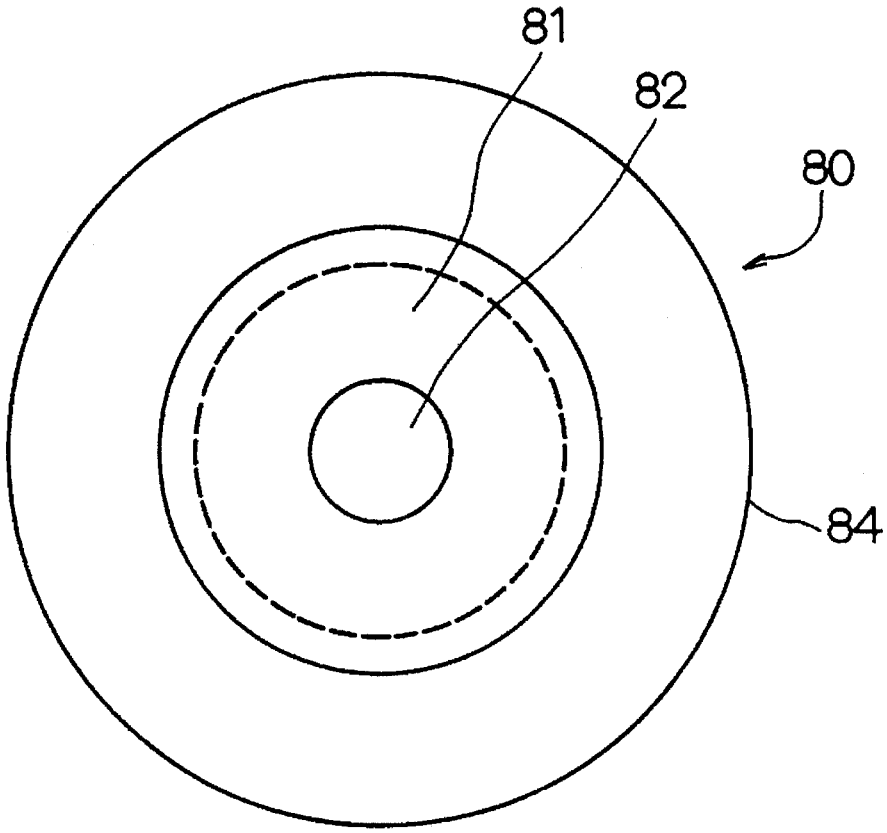
FIGS. 14A and 14B are views of an adjusting screw according to an eighth embodiment.
Figure 14B:
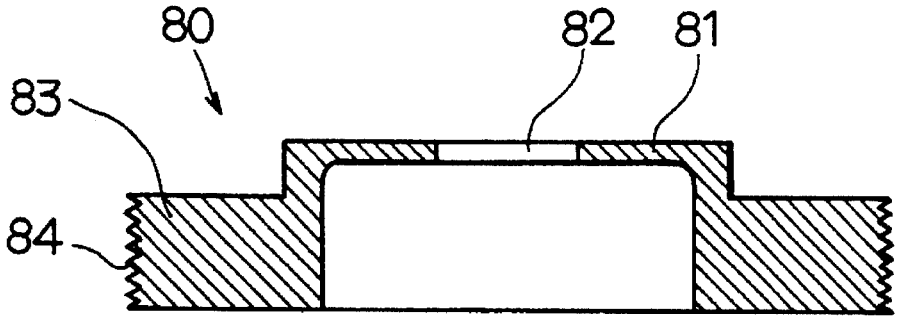
Figure 15:
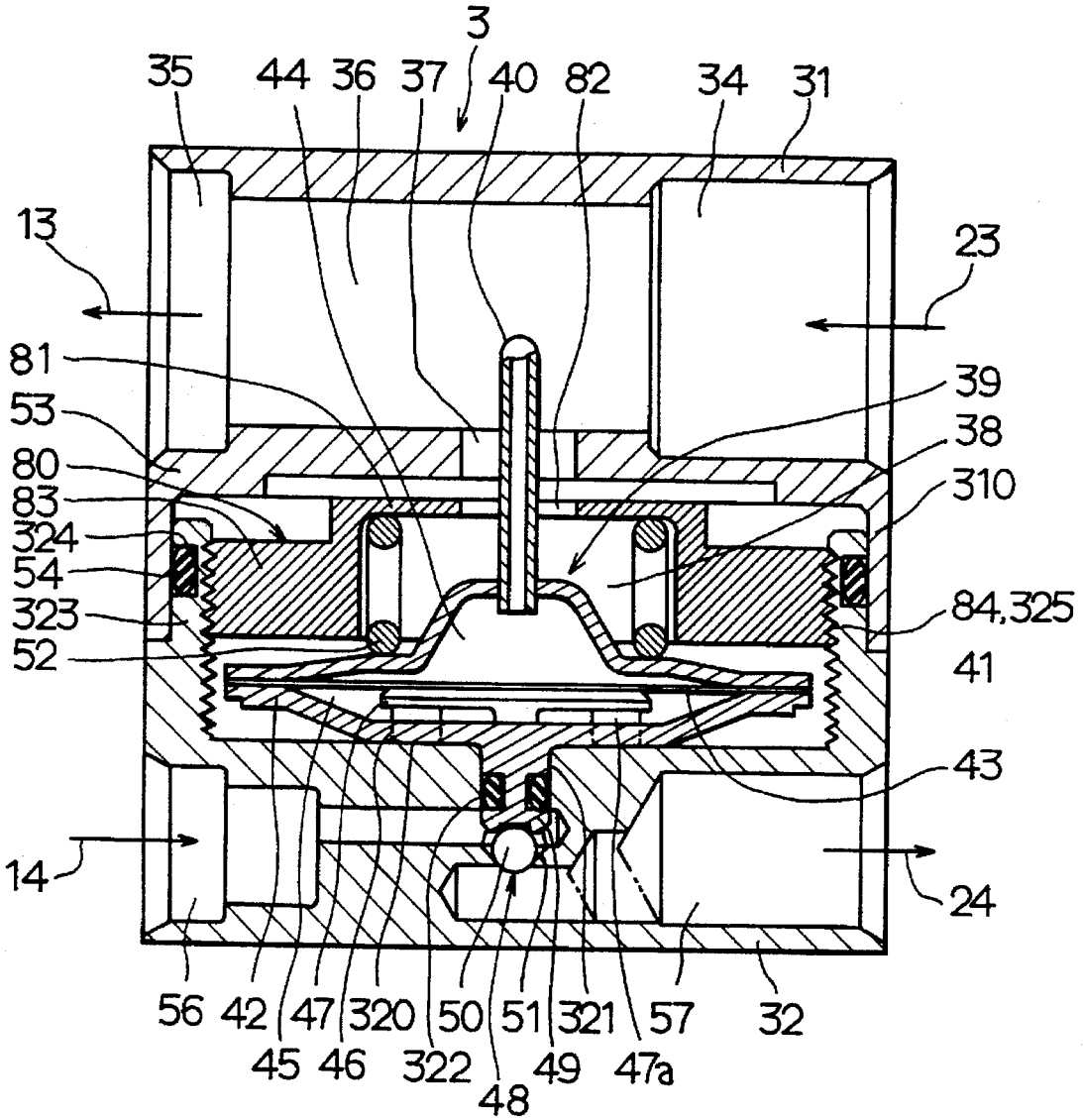
FIG. 15 is a cross sectional view of an thermal expansion valve according to the eighth embodiment of the present invention.

In the eighth embodiment, the adjusting screw 80 of the seventh embodiment is modified as illustrated in FIG. 14 and assembled as illustrated in FIG. 15. According to the embodiment illustrated in FIG, 14, the adjusting screw 80 is formed by machining instead of pressing a sheet metal. On the other hand, as illustrated in FIG. 15, on the second housing 32, a comparatively thick cylindrical protrusion portion 323 is provided. On the outer circumferential surface of the protrusion portion 323, an annular groove 324 is formed, and an O-ring 54 is fitted into the annular groove 342. Further to this, on the outer circumferential surface of the O-ring 54, a cylindrical protrusion portion 310 of the first housing 31 is assembled.

On the inner circumferential surface of the protrusion portion 323, a female thread 325 is formed. The male thread 84 of the adjusting screw 80 is screwed up to the female thread 325 to adjust the setting load of the coil spring 52. The remaining parts are the same as those of the seventh embodiment.

A ninth embodiment of the present invention is described.

Figure 16:
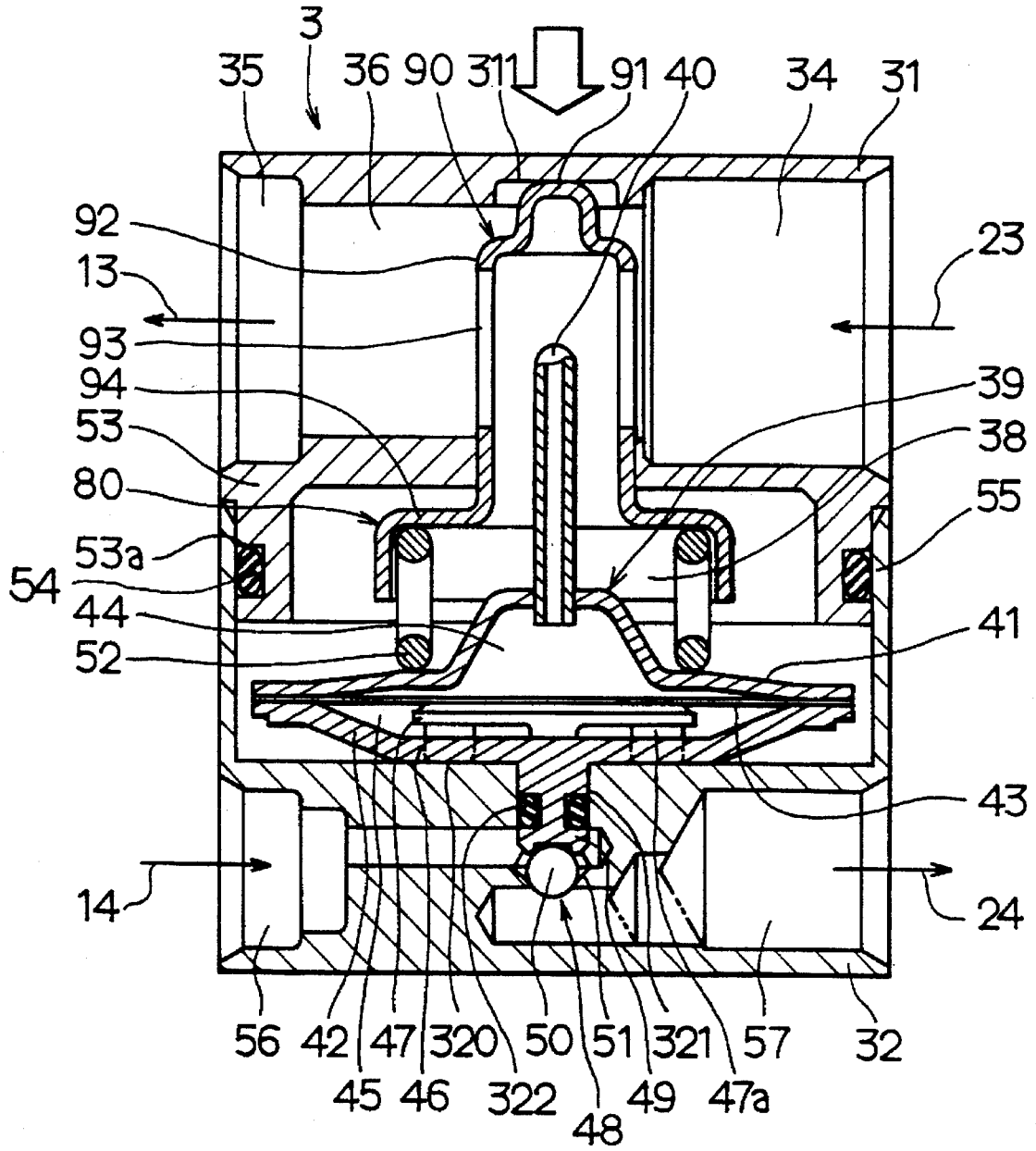
FIG. 16 is a cross sectional view of a thermal expansion valve according to a ninth embodiment of the present invention.
Figure 17A:
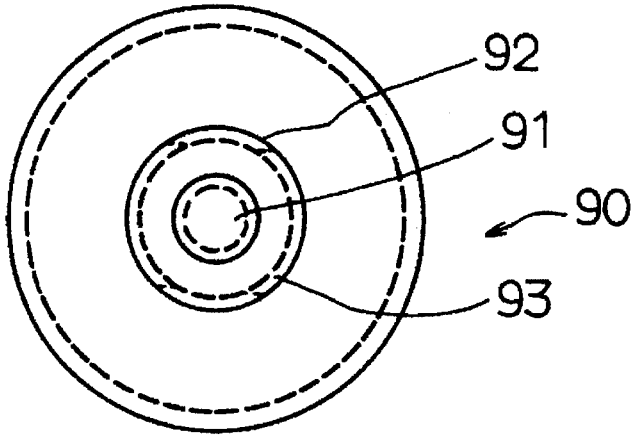
FIGS. 17A and 17B are views of a spring holding member according to the ninth embodiment.
Figure 17B:
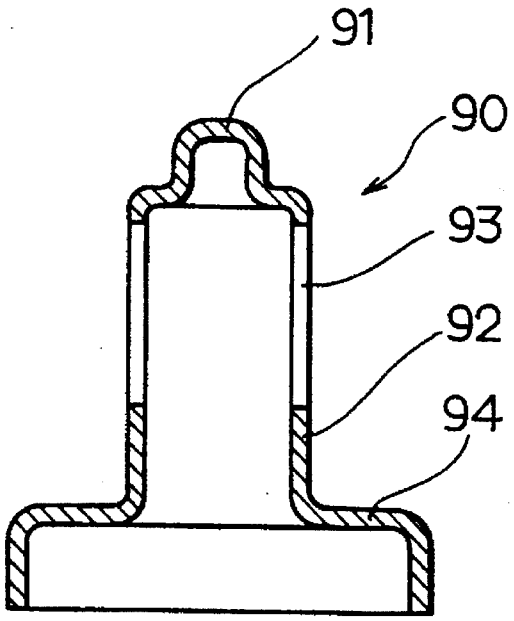

In the ninth embodiment illustrated in FIGS. 16 and 17, the setting load of the coil spring 52 can be adjusted after the thermal expansion valve 3 is assembled. In this embodiment, a metallic spring holding member 90 formed into a cylindrical cup shape as illustrated in FIG. 17 is used. On the bottom of the spring holding member 90, a small-diameter circular protrusion portion 91 is formed. In a cylindrical portion 92, a plurality of windows for the communication of the inside with the outside is provided. Furthermore, on the other end portion of the cylindrical portion 92, a cup portion 94 is formed so as to radially extend to the outside to support an end of the coil spring 52.

On the other hand, on the ceiling portion of the first housing 31, a recessed portion 311 is formed at a location where the small-diameter cylindrical protrusion part 91 of the spring holding member 90 faces. The end of the cylindrical protrusion portion 91 is in contact with the bottom of the recessed portion 311. The bottom of the recessed portion 311 is thinner than any other portion of the ceiling portion of the first housing 31 (e.g., approximately 2 mm) as to be easily deformed by a pressing force by a pressing machine. That is, the bottom portion of the recessed portion 311 forms a "press deformable wall surface" according to this embodiment.

According to the above structure, when the pressing force is applied to the recessed portion 311 of the ceiling portion of the first housing 31, the recessed portion 311 is deformed downwardly in FIG. 16 (toward the spring holding member 90) by a preset specified amount. Then, the spring holding member 90 moves downwardly, thereby adjusting the setting load of the coil spring 52.

Here, the plurality of window portions 93 in the cylindrical portion 92 of the spring holding member 90 serves to reduce the air flow resistance of the refrigerant flowing through the low-pressure side refrigerant passage 36.

A tenth embodiment of the present invention is described.

Figure 18:
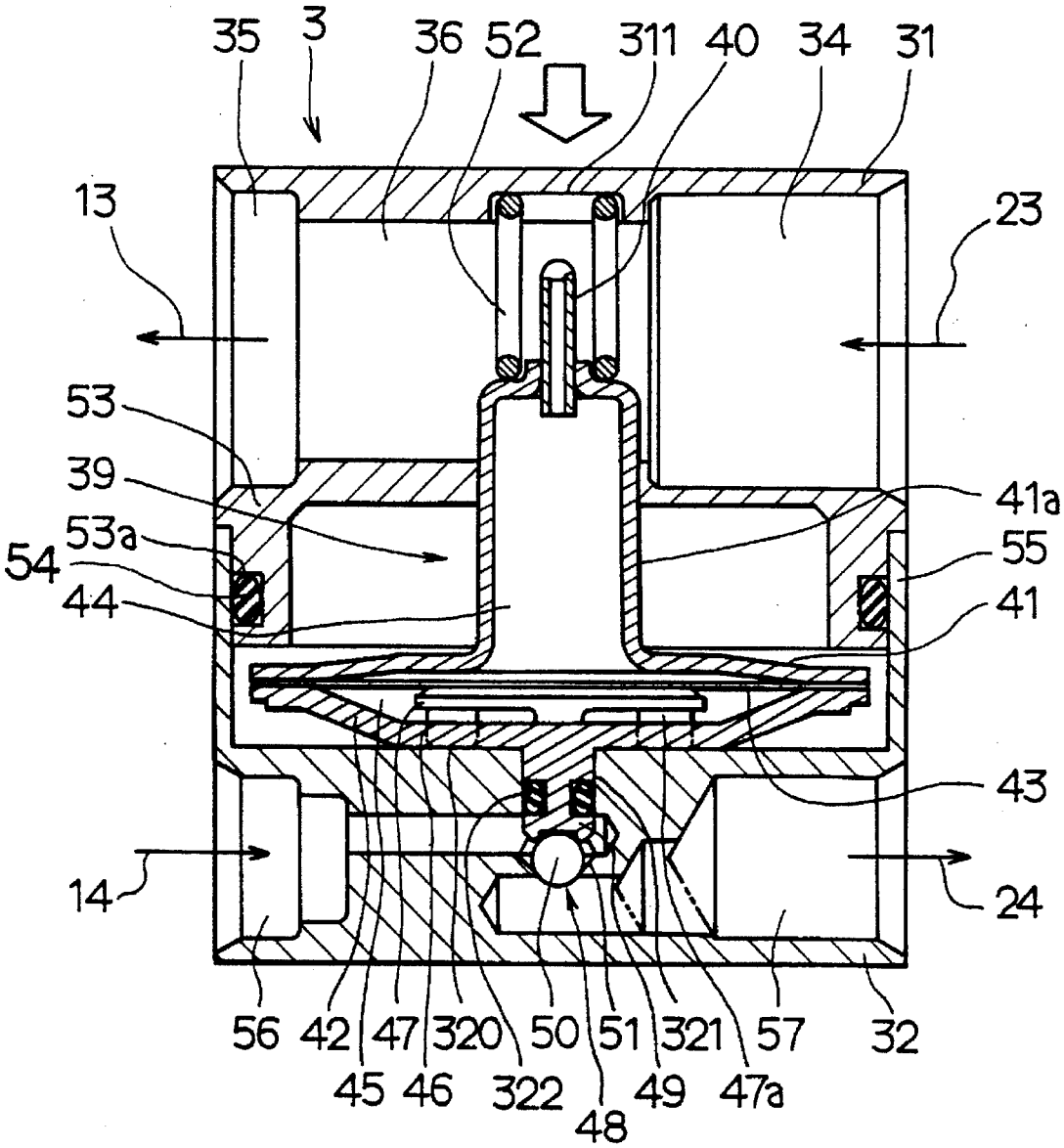
FIG. 18 is a cross sectional view of a thermal expansion valve according to a tenth embodiment of the present invention.

FIG. 18 illustrates the tenth embodiment of the present invention. In this embodiment, in the same way as the ninth embodiment, the recessed portion 311 of the ceiling portion of the first housing 31 is pressed and deformed, and thereby the setting load of the coil spring 52 is adjusted. This embodiment, however, is different from the ninth embodiment in that the deformation of the recessed portion 311 directly compresses and displaces the coil spring 52.

That is, by integrally forming the cylindrical portion 41*a* extending toward the recessed portion 311 on the diaphragm case 41 and disposing the coil spring 52 between the top of the cylindrical portion 41*a* and the recessed portion 311, when the recessed portion 311 is deformed, the coil spring 52 is directly compressed and displaced, and thereby the setting load of the coil spring 52 is adjusted.

As described above, the adjustment of the setting load of the coil spring 52 can be achieved in various ways.

The present invention has been described in connection with what are presently considered to be the most practical embodiments. However, the invention is not meant to be limited to the disclosed embodiments, but rather is intended to include all modifications and alternative arrangements included within the spirit and scope of the appended claims.

What is claimed is:

1. A thermal expansion valve for a refrigerating cycle having an evaporator for evaporating refrigerant, said thermal expansion valve expanding refrigerant flowing thereinto by decompressing said refrigerant according to overheat of refrigerant at an exit of said evaporator, said thermal expansion valve comprising:

a housing having a throttle passage therein for expanding said refrigerant thereinto from the high-pressure side liquid refrigerant circuit;

a valve element provided within said housing for adjusting opening degree of said throttle passage; and a thermosensitive element movably disposed within said housing, said thermosensitive element including a case and a pressure responding member disposed within said case and displacing according to temperature and pressure of the refrigerant at the exit of said evaporator; wherein, said case of said thermosensitive element is integrally connected to the valve element, and said thermosensitive element and said valve element are so constructed as to integrally move according to the displacement of said pressure responding member.

2. A thermal expansion valve for a refrigerating cycle having an evaporator for evaporating refrigerant, said thermal expansion valve expanding refrigerant flowing thereinto by decompressing said refrigerant according to overheat of refrigerant at an exit of said evaporator, said thermal expansion valve comprising:

a housing having a throttle passage therein for expanding said refrigerant thereinto from the high-pressure side liquid refrigerant circuit;

a valve element provided within said housing for adjusting opening degree of said throttle passage; and a thermosensitive element movably disposed within said housing, said thermosensitive element including:

an element case for forming therein a thermosensitive chamber for generating pressure according to temperature of the refrigerant at the exit of said evaporator and a pressure chamber for introducing pressure thereinto according to pressure of the refrigerant at the exit of said evaporator, and a pressure responding member fixedly disposed within said element case so as to partition said thermosensitive chamber and said pressure chamber and being displaced according to pressures within both chambers; and a spring member disposed on an outer surface of said element case and having a spring force; wherein said element case is integrally connected to said valve element, and said thermosensitive element and said valve element are so constructed as to integrally move according to the displacement of said pressure responding member.

3. A thermal expansion valve according to claim 2, wherein said element case includes two cases for sandwiching said pressure responding member therebetween.

4. A thermal expansion valve according to claim 2, wherein said spring member presses said element case in an closing direction of said valve element.

5. A thermal expansion valve according to claim 2, further comprising:

pressure introducing means disposed in said element case for introducing said pressure from the exit of said evaporator into said pressure chamber;

wherein said housing includes therein:

a low-pressure refrigerant passage, through which refrigerant from the exit of said evaporator flows, and a thermosensitive element chamber around said thermosensitive chamber for introducing said pressure from said low-pressure refrigerant passage into said pressure chamber therethrough.

6. A thermal expansion valve according to claim 2, further comprising:

a contacting member disposed within said pressure chamber and being adapted to be in contact with the pressure responding member, said contacting member including leg portions slidably passing through said element case and being adapted to be in contact with inner wall surface of said housing; wherein said element case and said valve element are so constructed as to integrally move by utilizing said inner wall surface of said housing and respective contacting portions of said leg portions as fulcrum.

7. A thermal expansion valve according to claim 6, wherein:

said element case includes a through hole through which said leg portions of said contacting member slidably pass, and pressure according to the refrigerant pressure at the exit of said evaporator is introduced into said pressure chamber through said through hole.

8. A thermal expansion valve according to claim 2, further comprising:

an adjusting screw member screwed up to said housing;

wherein an end of said spring member is adjustably supported by said adjusting screw.

9. A thermal expansion valve according to claim 2, further comprising:

a spring holding member for supporting an end of said spring member; wherein said housing includes a press deformable wall surface, one end of said spring holding member is positioned in opposition to said press deformable wall surface of said housing, and said end of said spring holding member is positioned by press deforming said wall surface.

10. A thermal expansion valve according to claim 2, wherein:

said housing includes a press deformable wall surface for supporting an end of said spring member, and said end of the spring member is positioned by press deforming said wall surface.

11. A refrigerating cycle for an automotive air conditioner comprising:

a condensing equipment group provided within an engine room and including a compressor for compressing and delivering refrigerant and a condenser for cooling and condensing gas refrigerant delivered from said compressor;

a cooling unit provided within an automotive compartment and including an evaporator for evaporating refrigerant to cool conditioned air; and a thermal expansion valve disposed between said condensing equipment group and said cooling unit for expanding refrigerant flowing thereinto by decompressing said refrigerant according to overheat of refrigerant at an exit of said evaporator, said thermal expansion valve including:

a housing having a throttle passage therein for expanding said refrigerant from said condensing equipment;

a valve element provided within said housing for adjusting opening degree of said throttle passage; and a thermosensitive element movably disposed within said housing, said thermosensitive element including a case and a pressure responding member disposed within said case and displacing according to temperature and pressure of the refrigerant at the exit of said evaporator; wherein, said case of said thermosensitive element is integrally connected to the valve element, and said thermosensitive element and said valve element are so constructed as to integrally move according to the displacement of said pressure responding member.

* * * * *